United States Patent [19]

Wesson et al.

[11] Patent Number: 5,062,485

[45] Date of Patent: Nov. 5, 1991

[54] VARIABLE TIME DELAY FIRING HEAD

[75] Inventors: David S. Wesson, Waxahachie; Kevin R. George, Columbus, both of Tex.

[73] Assignee: Halliburton Company, Duncan, Okla.

[21] Appl. No.: 321,471

[22] Filed: Mar. 9, 1989

[51] Int. Cl.[5] ..... E21B 43/1185

[52] U.S. Cl. ..... 166/297; 166/63; 102/312

[58] Field of Search ..... 166/297, 63; 102/312, 102/313, 322; 89/1.13

[56] References Cited

U.S. PATENT DOCUMENTS

| | | | |
|---|---|---|---|
| 4,572,288 | 2/1986 | Kinley | 166/63 |
| 4,614,156 | 9/1986 | Colle, Jr. et al. | 166/63 X |
| 4,619,333 | 10/1986 | George | 175/4.52 |

*Primary Examiner*—William P. Neuder
*Attorney, Agent, or Firm*—James R. Duzan

[57] ABSTRACT

The device of the present invention comprises first means for initiating a first combustive reaction which is actuated in response to a first pressure condition in at least a portion of the well bore, means to initiate any desired number of additional combustive reactions, and means for actuation an explosive charge to actuate perforating guns, or the like, in the well bore.

14 Claims, 3 Drawing Sheets

VARIABLE TIME DELAY FIRING HEAD

BACKGROUND OF THE INVENTION

The present invention relates to an improved device for use in actuating an explosive charge downhole in a well bore. More specifically, the present invention relates to an improved time delay actuating device for use in actuating an explosive charge downhole wherein the amount of time delay may be varied.

Explosive charges are utilized in wellbores to perform various functions, for example, to perforate a well casing to complete or test a formation, or to set a packer or other device downhole. Due to the time and expense involved in these operations and the explosive power of these devices, it is essential that their operation be reliable. The typical wellbore environment poses severe difficulties for the operation of explosive devices downhole, which thus tends to reduce their reliability. For example, extremes of temperature are common which tend to degrade the operation of explosives, and the presence of heavy drilling muds and debris can interfere with a firing apparatus. Impact responsive firing heads can become fouled by debris and particles settling out from the drilling mud.

In some applications, it is not feasible to utilize an impact responsive firing head. In drill stem testing, a zone to be tested is perforated and various downhole parameters such as temperature and pressure are monitored by instruments mounted between the tubing and the firing head. These are non-fullbore opening devices which typically do not permit a detonating bar to pass through to the firing head. In these applications, therefore, pressure responsive firing devices are desired for use.

A complication introduced in the use of pressure responsive firing devices, is that they require the manipulation of pressure in the annulus or the tubing to actuate the firing device. There are, however, numerous applications which call for the maintenance of a relatively low pressure at the time of explosive actuation, such as where it is desired to perforate the casing underbalanced. This requirement may not be compatible, therefore, with the use of pressure responsive firing devices operated by increasing pressure above hydrostatic.

In U.S. Pat. No. 4,614,156 a device is disclosed for actuating an explosive charge downhole in a wellbore. The device comprises first means for initiating a combustive reaction and actuated in response to a first pressure condition in at least a portion of the wellbore and second means for actuating the explosive charge. The device also includes delay means for providing a combustive reaction initiated by the initiating means and continuing for a time delay period providing sufficient time for an operator to alter the first pressure condition to a second pressure condition desired at the time of explosive actuation. The delay means is operative at the end of the time delay period after initation to actuate the explosive charge. Accordingly, it is thus possible to actuate the explosive charge by means of pressure downhole, while having the capability of reducing the pressure to a desired value, for example, a value desired for shooting underbalanced, before the perforating guns are actuated.

The device further comprises means for providing a signal indicating the actuation of the first means in a form adapted to be transmitted to the surface of the wellbore. Accordingly, the operator can be informed that the delay means has been actuated so that he can begin to bleed off pressure in the wellbore, if so desired, prior to actuation of the explosive.

In accordance with a further aspect of the device, the delay means is disposed in a chamber to which it is adapted to release combustion gas as its combustive reaction proceeds. The device further comprises means for venting the combustive gas released by the delay means from the chamber outwardly of the device. Thus, heat and pressure from the delay means is dissipated outside the device as the combustive reaction proceeds. This aids in preventing a build up of temperature and pressure in the chamber which, if not prevented, may cause the time delay to become unpredictable.

A yet further aspect of the device, a method is provided of perforating the casing of a cased borehole at a desired location and at a desired perforating pressure condition within the casing adjacent the desired location. The method comprises the steps of positioning a perforating means adjacent the desired location increasing the pressure within the casing adjacent the desired location from a first condition to a second, initiating pressure condition greater than the first condition and the desired perforating pressure condition, to initiate a time delayed perforator of the casing; and thereafter reducing the pressure within the casing adjacent the desired location from the initiating pressure condition to the desired perforating pressure condition prior to the perforation of the casing.

Although the above device is acceptable in most circumstances, in some instances, it is desirable to be able to vary the amount of time delay before the actuation of the explosive to accomodate a wide variety of well operations and conditions at the surface.

SUMMARY OF THE INVENTION

The present invention relates to an improved device for use in actuating an explosive charge downhole in a well bore. More specifically, the present invention relates to an improved time delay actuating device for use in actuating an explosive charge downhole wherein the amount of time delay may be varied.

The device of the present invention comprises first means for initiating a first combustive reaction which is actuated in response to a first pressure condition in at least a portion of the well bore, means to initiate any desired number of additional combustive reactions, and means for actuating an explosive charge to actuate perforating guns, or the like, in the well bore. The device of the present invention also includes variable delay means for providing a combustive reaction initiated by the initiating means and continuing for a preselected time delay period to provide sufficient time delay for an operator to alter the first pressure condition to any desired pressure condition desired at the time of explosive actuation. The variable delay means is operative at the end of the time delay period after initiation thereof to actuate the explosive charge. Accordingly, it is thus possible to actuate the explosive charge by means of downhole pressure, while having the capability of reducing the pressure to any desired value, for example, a value desired for shooting at any desired underbalanced, before the perforating guns are actuated.

A further aspect of the variable delay device is a method of perforating the casing of a cased borehole at a desired locating and at a desired perforating pressure condition within the casing adjacent the desired location. The method comprises the steps of positioning a perforating means adjacent the desired location, increasing the pressure within the casing adjacent the desired location from a first condition to a second condition thereby initiating a pressure condition greater than the first condition and the desired perforating pressure condition in the borehole, the second condition thereby initiating a preselected variable time delay perforation of the casing, and thereafter reducing the pressure within the casing adjacent the desired location from the initiating pressure condition to the desired perforating pressure prior to the perforation of the casing.

BRIEF DESCRIPTION OF THE DRAWINGS

The present invention will be understood more clearly and fully from the following description of certain preferred embodiments when read with reference to the accompanying drawings, in which.

DETAILED DESCRIPTION OF THE INVENTION

Figure 1:
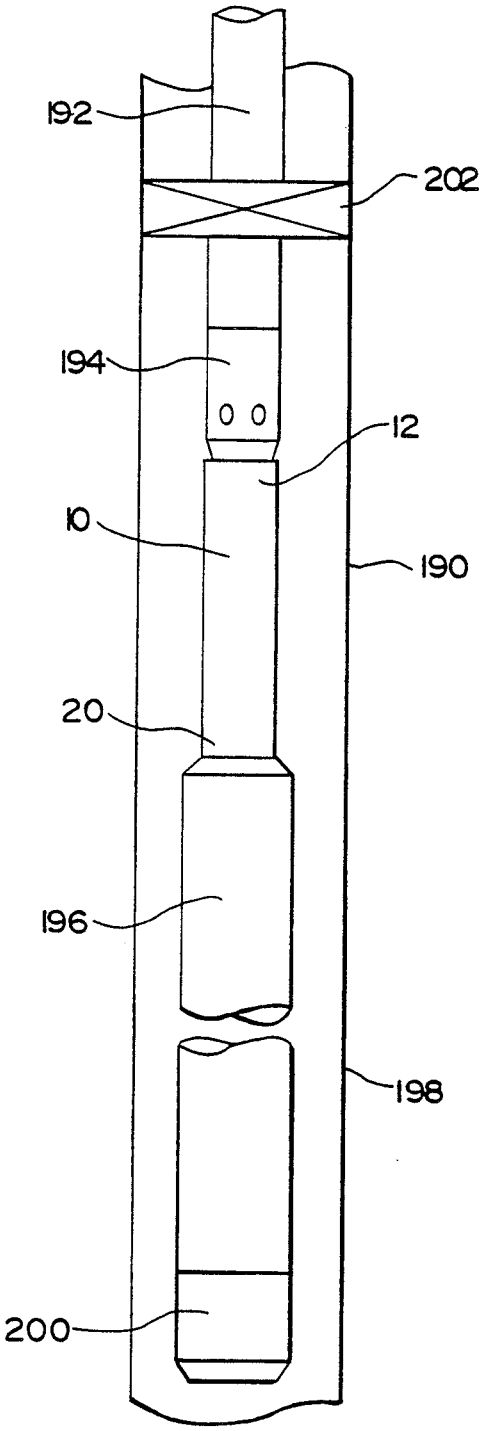
FIG. 1 is a partially cross-sectional view of a borehole in the earth wherein tubing conveyed perforating guns have been positioned to perforate the casing at a desired depth utilizing the present invention.

Referring to FIG. 1, the variable delay device 10 is shown in a perforating string in a borehole having a casing 190. A tubing string 192 terminates at its lower end by a perforated nipple 194. The upper sub 12 of the device 10 is threadedly coupled to the lower extremity of the nipple 194 and a lower portion 20 is threadedly coupled to a string of perforating guns 196 extending downwardly therefrom and positioned opposite a portion 198 of the casing 190 which it is desired to perforate with the guns 196. Coupled to the guns at their lowermost extremity is a shot detection device 200 which is operative to provide a signal transmitted upwardly through the tubing string 192 to the wellhead after a time delay provided by a combustive time delay element incorporated within the shot detection device 200. Shot detection device 200 may be, for example, that disclosed in U.S. Pat. No. 4,418,294. Once the guns 196 have been positioned adjacent the desired location 198, a packer 202 carried by the tubing string 192 and positioned above the perforated nipple 194 is set to isolate the casing annulus therebelow from the annulus above the packer. If it is desired to perforate the casing with an underbalanced condition in the lower annulus, the hydrostatic pressure in the lower annulus is adjusted accordingly, for example by swabbing well fluids from the tubing string 192. When it is desired to fire the guns 196, the heavier fluid in the tubing 192 is replaced with a lighter fluid to give the desired underbalance and then the pressure in the tubing string is increased by an operator at the wellhead.

Several seconds after the firing of the guns, the device 200 emits a vibrational signal through the tubing string to the surface in the event that the detonating cord within the guns 196 has detonated its entire length.

Figure 2:
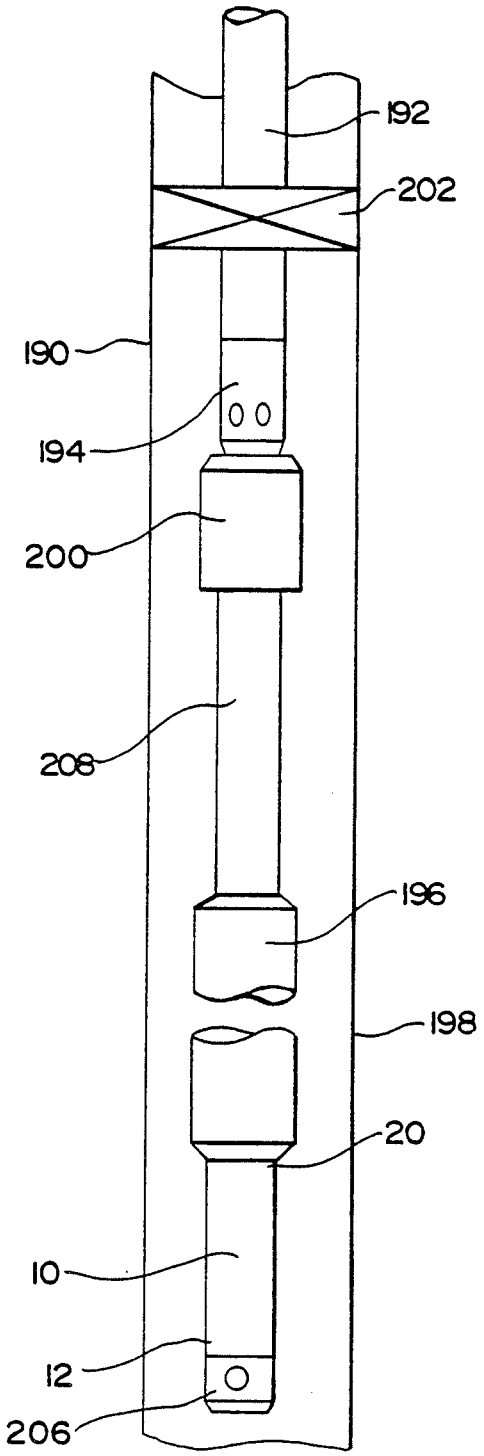
FIG. 2 is a partially cross-sectional view of a borehole in the earth illustrating an alternative arrangement for perforating the casing utilizing tubing conveyed perforating guns utilizing the present invention.

The arrangement of FIG. 2 differs from that of FIG. 1 in that the device 10 has been mounted beneath the perforating guns 198 and in an upside-down arrangement so that its normally upper end 12 is now the lowermost portion of the device 10. A perforated bull plug 206 is threadedly coupled to end 12 of device 10 so that pressure within the annulus beneath the packer 202 can be applied to the piston 30 of device 10. The guns 198 are suspended from blank, fluid tight tubing 208 which in turn is suspended from the shot detection device 200. Device 200 is in turn coupled at its upper end to the perforated nipple 194. An advantage of the FIG. 2 arrangement is that if fluid pressure invades the guns 198 or blank tubing 208 prior to detonation, fluids will accumulate in the device 10. By utilizing a fluid sensitive detonator in device 10, so that fluid in guns 198 accumulates below in the device 10, detonation of a wet string of guns can be prevented in the arrangement of FIG. 2.

In applications wherein long strings of guns are to be detonated by the device 10, requiring the use of boosters to transfer the detonation from one length of detonating cord to the next, it is preferable that bi-directional boosters be employed. Such boosters include a single secondary high explosive which will act on both as an acceptor and a donor, such as those described in U.S. Pat. No. 4,616,566.

The device of the present invention is also advantageous for use in drill stem testing, wherein non-fullbore opening devices are suspended in the tubing string above the perforating guns. Such devices render it difficult to pass a detonating bar downwardly through the tubing to impact upon a mechanical firing head, but do not affect the operation of a pressure actuated initiator such as device 10.

Other advantageous applications of the device 10 include multiple zone firing operations wherein two or more zones are to be perforated simultaneously or at different respective times. Such operations are disclosed in U.S. Pat. No. 4,619,333.

Figure 3:
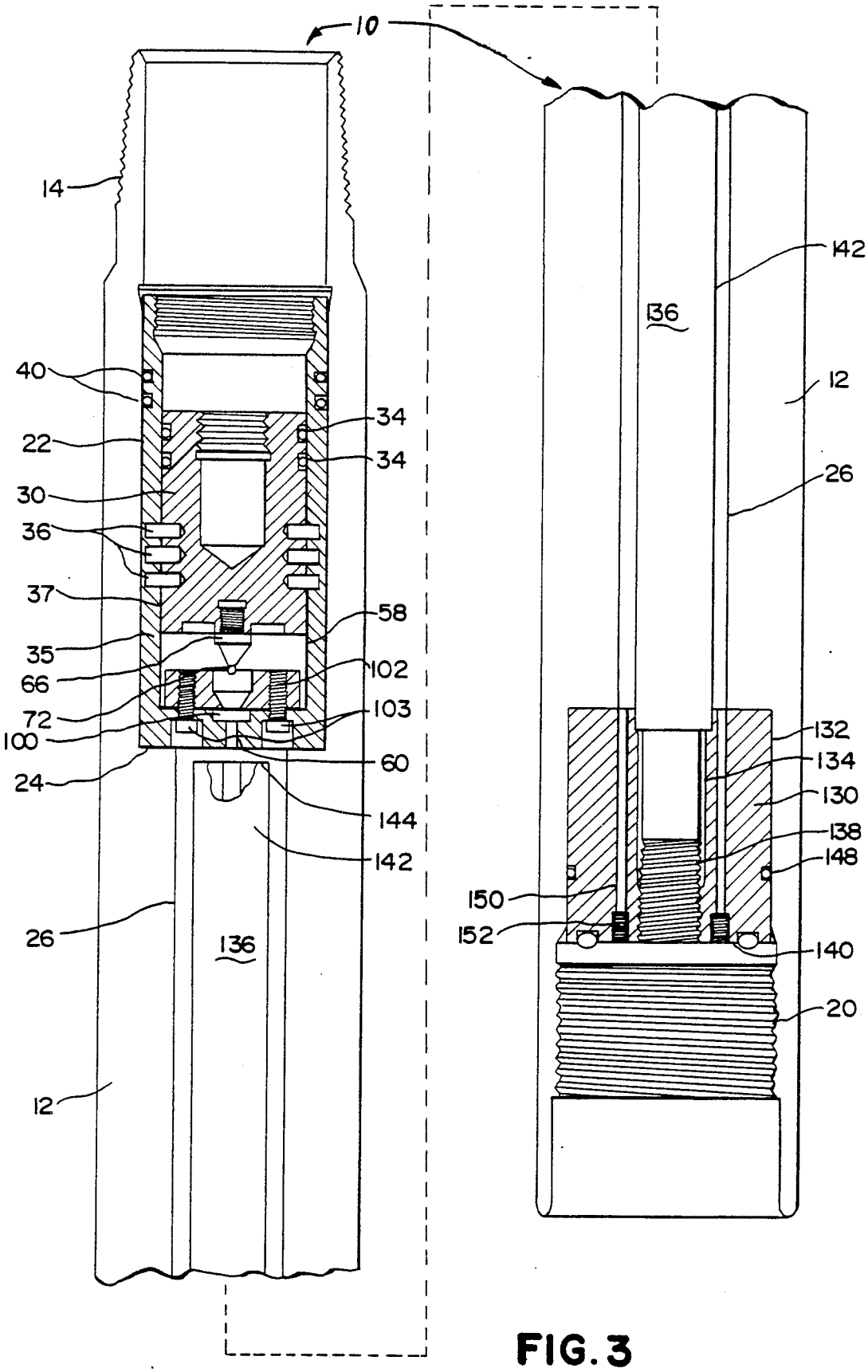
FIG. 3 is a partially cross-sectional view of a portion of the variable delay device in accordance with one embodiment of the present invention for actuating an explosive charge downhole.

With reference first to FIG. 3, the variable delay device 10 thereof includes a housing 12 having an upper set of threads 14 for coupling the device 10 to a tubing string for lowering into a well, or for coupling other downhole devices to device 10.

Housing 12 is threaded at a lower portion 20 thereof for coupling the device 10 to a perforating gun or other downhole device.

Housing 12 has a first relatively large diameter counterbore 22 bounded at its lower extremity by an annular shoulder 24. Beginning at an inner edge of shoulder 24 is a downwardly extending second, relatively smaller diameter counterbore 26 extending through a lower extremity of housing 12. A piston 30 is slidably, releasably retained within piston retainer 35 having two O-rings seals 34 providing a fluid tight seal between the piston 32 and the counterbore 37 of retainer 35. Piston retainer further includes two O-ring seals 40 to sealingly engage counterbore 22 of housing 12. An annularly shaped piston retainer 35 is fitted within counterbore 22 and is prevented from moving downwardly within upper sub 12 by the shoulder 24. Retainer 35 has an inner surface dimensioned to fit closely against the outer surface of the piston 30. Shear pins 36 couple the piston 30 to the piston retainer 35 to restrain the piston 30 against movement downwardly with respect to upper sub 12 until such time as a sufficient pressure differential is applied across the piston 30 to shear the pins 36.

A firing pin 66 is threadedly releasably secured to the bottom of piston 30. A lower portion of firing pin 66 is formed having a narrow projection 72 which impacts against a percussion primer assembly 100 when the firing pin 66 secured to piston 30 is forced downwardly. Assembly 100 is held in counterbore 58 of piston retainer 35 by a primer retainer 102 which threadedly, releasably to piston retainer 35 bo means of screws 103. Retainer 102 has a concentric opening therethrough shaped to receive the lower portion of firing pin 66 and guide the projection 72 into engagement with the primer assembly 100.

With reference again to FIG. 3, a lower plug 130 is threadedly received within a counterbore 132 of the lower portion of housing 12. Lower plug 130 has a central aperture 134 therethrough with a threaded lower portion. An elongated, generally cylindrical delay element assembly 136 is threaded at a reduced diameter lower portion 138 thereof. Portion 138 of assembly 136 is threaded into the aperture 134 so that a lower surface of portion 138 is flush with a lower surface 140 of plug 130. An upper relatively larger diameter portion 142 of assembly 136 extends upwardly from plug 130. An upper surface 144 of portion 142 is disposed adjacent aperture 60 of piston retainr 35. Housing 12 has counterbore 26 spaced from upper portion 142 of assembly 136 to define a plenum chamber therebetween. The lower plug 130 also includes resilient O-rings 148 to sealingly engage bore 26 of housing 12 or to another member.

In operation, the jet of gases and hot particles emitted through aperture 60 by primer assembly 100 in response to the impact of projection 72 of firing pin 66 acts as a signal to initiate a combustive reaction within assembly 136. As the combustive reaction proceeds within assembly 136, combustion gas exists from assembly 136 and fills the plenum chamber.

Lower plug 130 is provided with a plurality of apertures 150 therethrough and sealed at their lower ends by set screws 152. Accordingly, the principal factor in determining the length of the delay provided by the delay element assembly 136 is the downhole ambient temperature.

Figure 4:
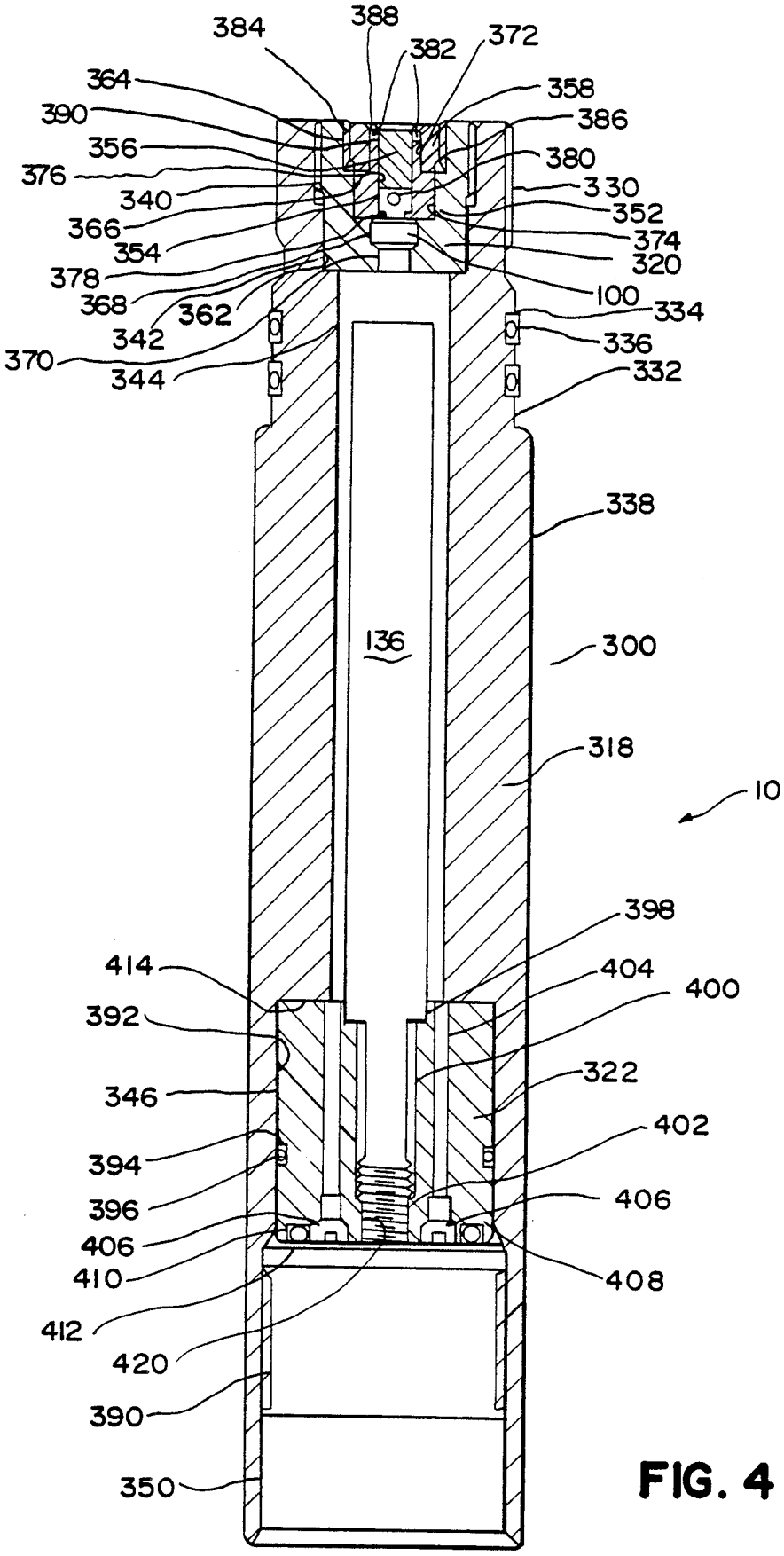
FIG. 4 is a cross-sectional view of another portion of the variable delay device in accordance with one embodiment of the present invention for actuating an explosive charge downhole.

Referring to FIG. 4, the extended time delay module 300 of the variable delay device 10 is shown. After the combustion of the delay element assembly 136 has been completed in the housing 18, for extended periods of delay in time before the perforating guns 196 (see FIGS. 1 and 2) are fired one or more extended time delay modules 300 are used in series with delay element assembly 136.

The extended time delay module 300 comprises a housing 318, upper plug assembly 320, lower plug assembly 322 and delay element assembly 136.

The housing 318 comprises an elongated annular cylindrical member having, on the exterior thereof, threaded portion 330, which releasingly, threadedly engages lower threaded portion 20 of housing 18, first cylindrical surface 332 having, in turn, a plurality of annular recesses 334 therein containing resilient O-rings 336 therein to sealingly engage a portion of the interior of housing 18 and second cylindrical surface 338 and, on the interior thereof, first threaded bore 340, first bore 342, second bore 344, third bore 346, second threaded bore 348 and fourth bore 350.

The upper plug assembly 320 comprises primer sleeve 352, piston sleeve 354, striker piston 356 and piston retainer sleeve 358.

The primer sleeve 352 comprises an annular cylindrical member having, on the exterior thereof, threaded surface 360 which releasably, threadedly engages threaded bore 340 of housing 318, and cylindrical surface 362 which is received in first bore 342 of housing 318 and, on the interior thereof, threaded bore 364, first bore 366, second bore 368 in which initiator 100 is received and third bore 370.

The piston sleeve 354 comprises an annular cylindrical member having, on the exterior thereof, first cylindrical surface 372 and second cylindrical surface 374 and, on the interior thereof, first bore 376 and second bore 378.

The striker piston 356 comprises a cylindrical member having and intergral firing pin or projection 380 on one end thereof and, on the other end thereof, a plurality of shearable ears 382 which abut and are initially retained on the upper end of piston sleeve 354. The striker piston is slidable within first bore 376 of piston sleeve 354.

The piston retainer sleeve 358 comprises an annular cylindrical member having, on the exterior thereof, threaded surface 384 which releasably, threadedly engages threaded bore 364 of primer sleeve 352 and cylindrical surface 386, and on the interior thereof, annular shoulder 388 which abuts the shearable ears 382 on striker piston 356 to retain the ears 382 of the striker piston 356 on piston sleeve 354 and bore 390 which slidably engages first cylindrical surface 372 of piston sleeve 354.

The lower plug assembly 322 comprises an annular cylindrical member having, on the exterior thereof, cylindrical surface 392 having, in turn, annular recess 394 therein containing resilient O-ring 396 therein sealingly engaging third bore 346 of housing 318 and, on the interior thereof, first bore 398, second bore 400 and threaded bore 402. The lower plug assembly 322 further comprises a plurality of apertures 404 extending between the upper 414 and lower 408 surfaces of the annular cylindrical member with each aperture 404 having a threaded insert 406 sealing the aperture 404 from fluid entry through the bottom thereof. On the lower surface 408 of the annular cylindrical member further includes annular recess 410 having, in turn, resilient O-ring therein to sealingly engage another extended time delay module 300, top of a perforating gun or other downhole tool to prevent fluid leakage from the well bore thereinto.

The delay element assembly 136 is releasably threadedly retained within the lower plug assembly 322 by means of a threaded portion 420 on the delay assembly 136 engaging threaded bore 402 of the lower plug assembly 322. The delay element assembly is shown and described in U.S. Pat. No. 4,614,156.

Similarly, the initiator 100 used in the upper plug assembly 320 is shown and described in U.S. Pat. No. 4,614,156.

OPERATION OF THE INVENTION

Referring to FIGS. 1, 3 and 4, to actuate the variable delay device 10 of the present invention which includes one or more extended time delay modules 300 pressure in the tubing string 192 is increased until the pins 36 shearing causing the piston 30 to move downwardly very rapidly ramming the projection 72 into the assembly 100 to initiate the combustive reaction within delay assembly 136. The downward motion of the piston 30 is arrested when the bottom thereof impacts upon the upper surface of primer retainer 102.

At this time as the combustive reaction proceeds within the assembly 136 pressure in the tubing string 192 may begin to be reduced. When the combustive reaction is completed within assembly 136, an explosive charge in the assembly 136 is detonated which, in turn, causes the striker piston 356 in the upper plug assembly 320 to shear ears 372 thereon, move downwardly very rapidly and ram firing pin or projection 380 into initiator assembly 100 to initiate the combustive reaction within delay assembly 136 in extended time delay module 300. When the combustive reaction is completed within assembly 136, an explosive charge detonates to either fire the perforating guns 196 or actuate another extended time delay module 300, whichever is secured to housing 318 of module 300.

By providing a plurality of extended time delay modules 300, in series, any desired amount of time delay may be provided before the actuation of the perforating guns 196. It is understood that by adding additional extended time delay modules 300 the desired amount of time delay is provided in increments of time equal to the combustive reaction time of delay assembly 136 in each module 300, although each combustive delay assembly 136 may have a differing reaction time.

The terms and expressions which have been employed are used as terms of description and not of limitation, and there is no intention in the use of such terms and expressions of excluding any equivalents of the features shown and described, or portions thereof, it being recognized that various modifications are possible within the scope of the invention claimed.

For instance, a series of hydraulic time delay modules could be connected in seriation to provide the mechanical equivalent of a combustible fuse type time dealy.

Thus, we claim:

1. A device for actuating an explosive charge downhole in a wellbore, comprising:

a first assembly which includes an impact piston;

a first primer assembly for initiating a combustive reaction and actuated in response to an impact thereto from the impact piston of the first assembly;

a second high output explosive charge;

a first combustive delay means for providing a combustive reaction initiated by the first primer assembly and a continuing combustive reaction for a time delay period providing sufficient time for an operator to alter a first pressure condition to a second pressure condition desired at the time of explosive actuation, the first combustive delay means continuing to provide a first combustive reaction at the end of the time delay period after the initiation thereof to actuate the second high output explosive charges; and a second assembly which includes an impact piston;

a first primer assembly for initiating a combustive reaction and actuated in response to a force thereto from the second high output explosive charge of the first assembly;

a third high output explosive charge for actuating said explosive charge; and a second combustive delay means for providing a combustive reaction initiated by the second primer assembly and a continuing combustive reaction for a time delay period, the second combustive delay means continuing to provide a second combustive reaction at the end of the time delay period after the initiation thereof to actuate the third high output explosive charge.

2. The device of claim 1 wherein the first assembly further comprises plug means for providing a signal adapted to be transmitted to the surface of the well bore when the plug means is impacted by a portion of the impact piston of the first assembly indicating the actuation of the first primer assembly.

3. The device of claim 1, further comprising means for maintaining the delay means below a predetermined pressure as the combustive reaction proceeds.

4. The device of claim 1, wherein the first and second combustive means are each disposed in a chamber.

5. The device of claim 4, wherein the device is adapted to be joined to a carrier of the explosive charge for actuating the charge.

6. A system for use in perforating a wall of a borehole extending from a ground level into the earth, comprising:

means for perforating the borehole wall in response to a stimulus;

means for supporting the perforating means adjacent a portion of the borehole wall to be perforated;

means for manipulating fluid pressure in the borehole from the ground level; and means for providing the stimulus to the perforating means after expiration of a time delay, the time delay of the stimulus providing means being of sufficient duration to permit a reduction in fluid pressure through the use of the pressure manipulating means to any level desired at the time the perforating means is actuated to perforate the borehole wall through the use of at least a first and second time delay before the actuation of the perforating means.

7. In a borehole, a method of perforating a wall of the borehole at a desired location and at a desired perforating pressure condition within the borehole adjacent the desired location, comprising:

positioning a perforating means adjacent the desired location;

a first time delayed combustive reaction;

a second time delayed combustive reaction in response to the first time delayed combustive reaction which, in turn, causes the performation of the wall of the borehole by the actuation of the perforating means; and thereafter, reducing the pressure within the borehole adjacent the desired location from the initiating pressure condition to the desired perforating pressure condition prior to the perforation of the wall of the borehole.

8. The method of claim 7, further comprising signalling the initiation of the time delayed perforation from the perforating means to a location remote therefrom to indicate that the pressure adjacent the desired location should be reduced.

9. The method of claim 9, wherein the step of initiating the time delayed perforation comprises striking a combustion initiator with a striker.

10. The method of claim 7, wherein the step of signalling the initiation of the time delayed perforation comprises coupling the vibrational signal to a tubing string run from the surface of the bore hole to the perforating means.

11. The method of claim 7, wherein the step of altering the pressure within the borehole comprises reducing the pressure to a desired perforating pressure which is less than pressure in an earth formation surrounding the location of the wall to be perforated.

12. The method of claim 7, wherein the step of altering the pressure within the borehole comprises adjusting borehole pressure at the wellhead.

13. The method of claim 7, further comprising the step of detecting the signal indicating the initiation of the time delayed perforation before carrying out the step of reducing pressure within the borehole.

14. A device for actuating an explosive charge downhole in a well bore, comprising:

first means for providing a first initiation force;

first combustive delay means responsive to the initiation force;

second means for providing a second initiation force;

second combustive delay means responsive to the second initiation force for providing sufficient time for an operator to alter a first pressure condition to a second pressure condition desired at the time of explosive actuation; and means for actuating the explosive charge in response to the actuation signal.

* * * * *